US006609268B2

(12) United States Patent
Miner

(10) Patent No.: US 6,609,268 B2
(45) Date of Patent: Aug. 26, 2003

(54) EXTRACTION CLEANING MACHINE WITH INSULATED SOLUTION TANK

(75) Inventor: Jonathan L. Miner, Rockford, MI (US)

(73) Assignee: Bissell Homecare, Inc., Grand Rapids, MI (US)

( * ) Notice: Subject to any disclaimer, the term of this patent is extended or adjusted under 35 U.S.C. 154(b) by 54 days.

(21) Appl. No.: 10/037,738

(22) Filed: Nov. 9, 2001

(65) Prior Publication Data

US 2003/0088939 A1 May 15, 2003

(51) Int. Cl.[7] ..... A47L 11/30
(52) U.S. Cl. ..... 15/320; 15/344
(58) Field of Search ..... 15/320, 321, 344

(56) References Cited

U.S. PATENT DOCUMENTS 3,089,790 A * 5/1963 Balamuth et al. ..... 134/1
3,262,146 A * 7/1966 Hays ..... 15/321
3,645,420 A 2/1972 Machado
3,959,010 A * 5/1976 Thompson et al. ..... 134/21
3,989,184 A 11/1976 Albishausen et al.
4,164,820 A 8/1979 Krickovich
4,227,279 A * 10/1980 Tribolet ..... 15/321
4,367,565 A 1/1983 Parise
4,696,074 A * 9/1987 Cavalli ..... 15/321
5,371,918 A 12/1994 Shero
5,806,238 A * 9/1998 Brenner et al. ..... 43/139
5,907,887 A 6/1999 Mansur
6,125,498 A 10/2000 Roberts et al.
6,131,237 A * 10/2000 Kasper et al. ..... 15/320
6,167,587 B1 1/2001 Kasper et al.

* cited by examiner

*Primary Examiner*—Terrence R. Till

(57) ABSTRACT

An extraction cleaner has a fluid recovery system, a liquid dispensing system for dispensing a fluid onto a surface to be cleaned and a liquid recovery system for recovered soiled fluid from the surface wherein a cleaning fluid supply tank has an insulated wall for maintaining the fluid at an elevated temperature suitable for effective cleaning.

18 Claims, 13 Drawing Sheets

EXTRACTION CLEANING MACHINE WITH INSULATED SOLUTION TANK

BACKGROUND OF THE INVENTION

1. Field of the Invention

The invention relates to extraction cleaning machines. In one of its aspects, the invention relates to an upright deep cleaner machine that is adapted to deliver a cleaning solution at an elevated temperature suitable for effective cleaning. In another of its aspects, the invention relates to a hand-held portable extraction cleaner which is adapted to deliver a cleaning solution at an elevated temperature suitable for effective cleaning. In yet another of its aspects, the invention relates to an extraction cleaner machine which is adapted to maintain a cleaning solution at an elevated temperature suitable for effective cleaning without any electrical heating elements.

2. Description of the Related Art

Extraction cleaning machines, or extractors, include a solution dispensing system for applying a cleaning solution to a surface being cleaned and a fluid recovery system for drawing the applied solution from the surface by application of a suction airflow.

It has been found that a cleaning solution used in an extractor is more effective when applied at an elevated temperature. In prior art extraction cleaning machines, the cleaning solution has been elevated to the proper temperature by one of two methods: the solution tank has been filled with heated fluid from an external source, or the solution has been heated during dispensing such as by an in-line heater.

The use of pre-heated solution has the disadvantage that as the user proceeds with using the extractor the solution tends to cool to a sub-optimal temperature, decreasing the effectiveness of the solution. The use of an in-line heater has the disadvantages of adding cost to the extractor. Further, during high flow rate periods of operation, the in-line heater can have trouble maintaining the dispensed solution at the proper temperature due to the temperature differential between the solution in the solution tank and the desired dispensed solution temperature.

It would be advantageous to provide an extraction cleaner a means to reduce heat loss in a pre-heated fluid to either eliminate the need for an in-line heater or increase the efficiency of the in-line heater by reducing the temperature differential between the solution in the solution tank and the optimal dispensing temperature of the cleaning solution.

SUMMARY OF THE INVENTION

According to the invention, a portable surface cleaning apparatus of the type that includes a base module for movement along a surface to be cleaned and an upright handle pivotally mounted to the base module, a fluid recovery system for recovering soiled fluid from the surface to be cleaned and a liquid dispensing system for applying liquid to a surface to be cleaned includes a thermally insulated fluid supply tank. The insulated fluid supply tank can be formed with an inner wall and an outer wall.

In one embodiment, the inner wall and the outer wall are separated by an air space therebetween. In this embodiment, integrally molded ribs are preferably formed between the inner wall and the outer wall for maintaining a separation distance between the inner wall and the outer wall.

In another embodiment, the inner wall and the outer wall are separated by an insulating material. The insulating material can be foam or a fibrous batting.

In another embodiment, the inner wall, and preferably, the outer wall is a flexible bladder. In another embodiment, the insulated fluid supply tank wall comprises a foam material. For example, the fluid supply tank can be formed of closed-cell foam that forms one or both of the inner and outer surfaces of the fluid supply tank.

In yet another embodiment, the thermally insulated tank wall includes an insulation coating. The insulated coating can be applied directly to an outer surface of a single layer tank.

Further according to the invention, a hand-held surface cleaning apparatus that includes a fluid recovery system for recovering soiled fluid from the surface to be cleaned and a liquid dispensing system for applying liquid to a surface to be cleaned includes a thermally insulated fluid supply tank. The insulated fluid supply tank can be formed with an inner wall and an outer wall.

In one embodiment, the inner wall and the outer wall are separated by an air space therebetween. In this embodiment, integrally molded ribs are preferably formed between the inner wall and the outer wall for maintaining a separation distance between the inner wall and the outer wall.

In another embodiment, the inner wall and the outer wall are separated by an insulating material. The insulating material can be foam or a fibrous batting.

In another embodiment, the insulated fluid supply tank wall comprises a foam material. For example, the fluid supply tank can be formed of closed-cell foam that forms one or both of the inner and outer surfaces of the fluid supply tank.

In yet another embodiment, the thermally insulated tank wall includes an insulation coating. The insulated coating can be applied directly to an outer surface of a single layer tank.

DESCRIPTION OF THE PREFERRED EMBODIMENT

Referring to FIGS. 1–4, an upright extraction cleaning machine 112 includes a base module 114, an upright handle 116 pivotally connected to the base module 114 and a pair of wheels 118 supporting in part the upright extraction cleaning machine 112. The upright extraction cleaning machine 112 includes a cleaning solution dispensing system and a fluid recovery system. The cleaning solution dispensing system applies a cleaning solution to the surface to be cleaned. The fluid recovery system applies a suction pressure to the surface being cleaned to recover fluid from the surface. The upright extraction cleaning machine 112 of FIGS. 1–4 is further described in commonly owned U.S. Pat. No. 6,167,587, which is incorporated herein by reference in its entirety.

Figure 1:
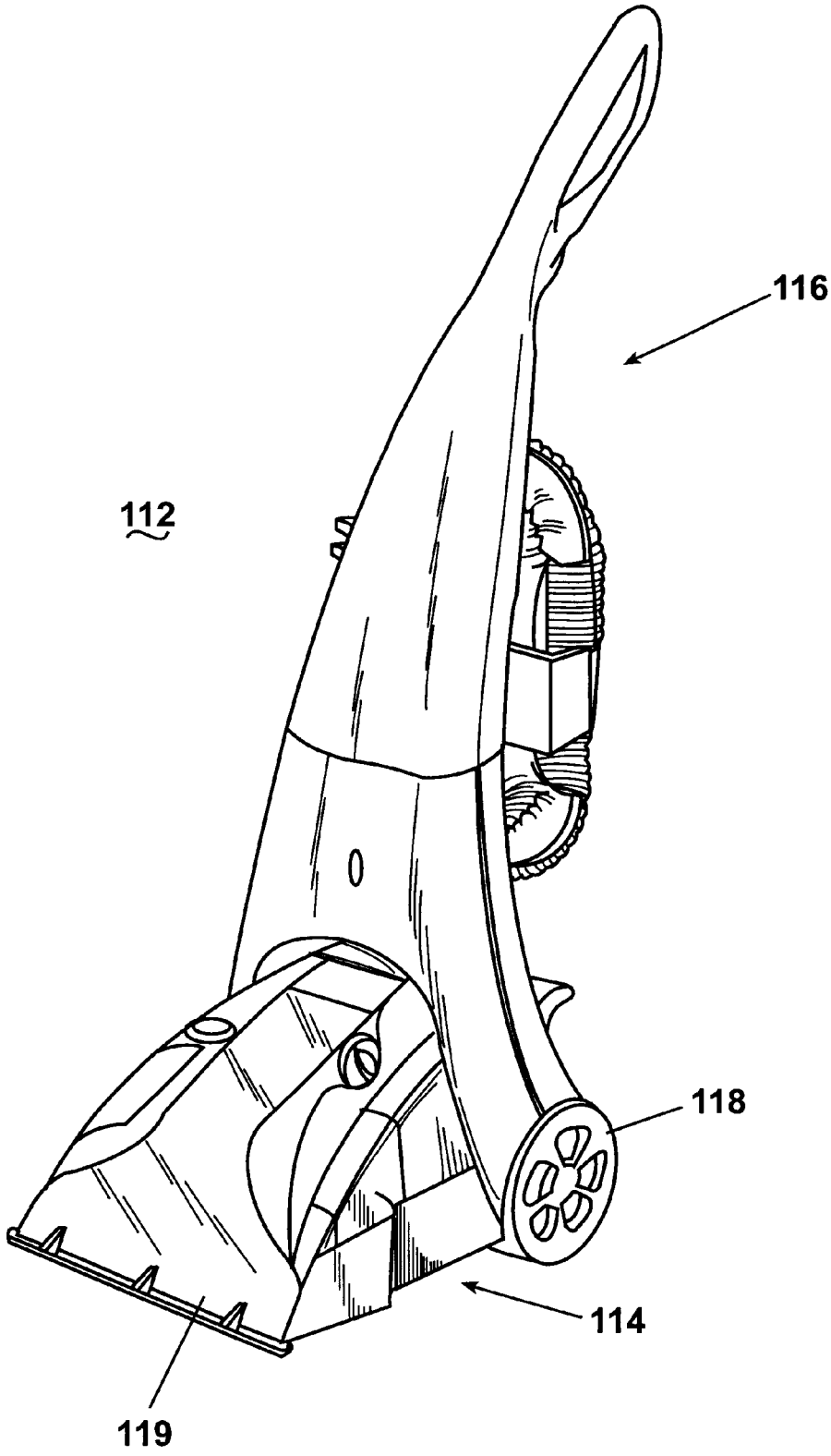
FIG. 1 is a perspective view of an upright extractor according to the invention.
Figure 2:
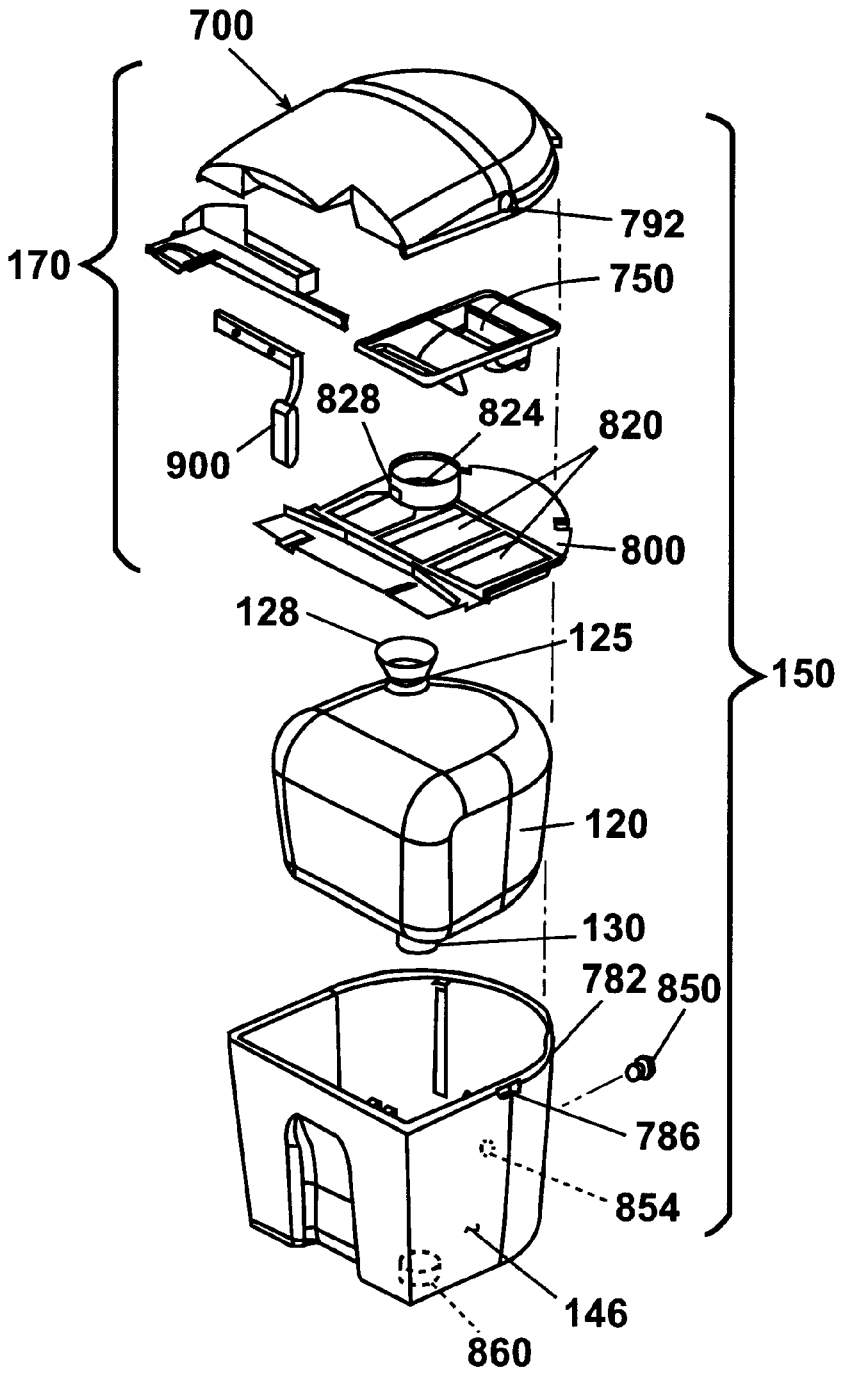
FIG. 2 is an exploded perspective view of a solution/recovery tank assembly of the upright extractor shown in FIG. 1.

In the disclosed embodiment, the base module 114 includes solution dispensing spray nozzles (not shown) for applying and removing cleaning solution from a surface to be cleaned and a suction nozzle 119 for removing soiled cleaning solution from the surface. Referring to FIG. 2, the solution dispensing spray nozzles are fluidly connected to a solution tank 120. The solution tank 120 is a flexible bladder comprising a portion of a solution/recovery tank assembly 150. The solution tank 120 is carried within a rigid recovery tank 146. The solution/recovery tank assembly 150 is removably mounted to the base module 114 for fluidly connecting to the solution dispensing system and the fluid recovery system.

Figure 3:
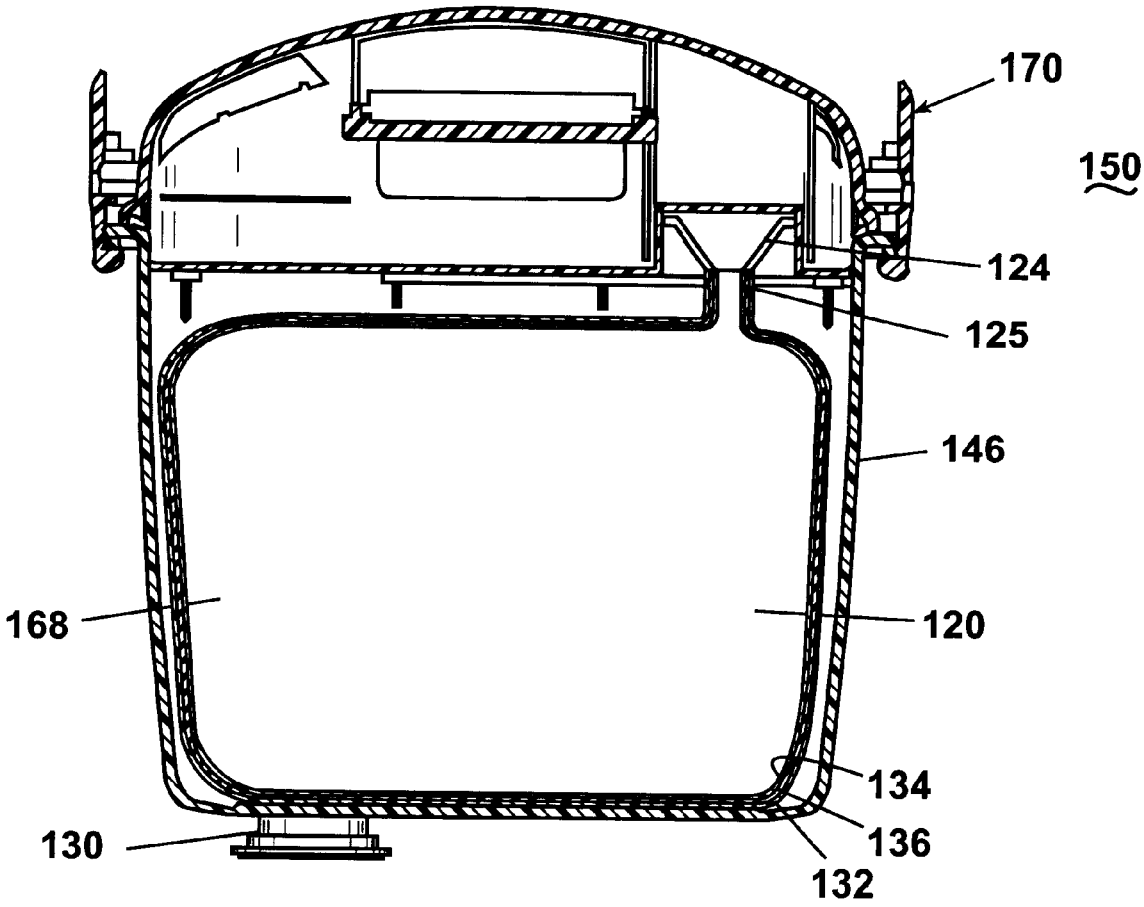
FIG. 3 is a cross-sectional view of a solution/recovery tank assembly of the upright extractor shown in FIGS. 1–2.

Referring to FIG. 3, the solution tank 120 comprises a double-wall construction having an outer wall 132 and an inner wall 134. The cavity between the outer and inner walls 132, 134 is filled with a flexible foam insulation barrier 136. During operation, as cleaning solution is dispensed from the solution tank 120, recovered fluid is deposited in the rigid recovery tank 146 to the outside of the outer wall 132 of the solution tank 120. The barrier 136 thermally isolates the solution within the solution tank 120 from the atmosphere or the recovered fluid in the recovery tank 146. The heat loss from the solution in the solution tank 120 is thus reduced to maintain the solution in the optimal temperature range for a longer time period. Further, extremely hot water can be placed in the solution tank 120 and handled by a user without danger of burning from a hot tank.

Figure 4:
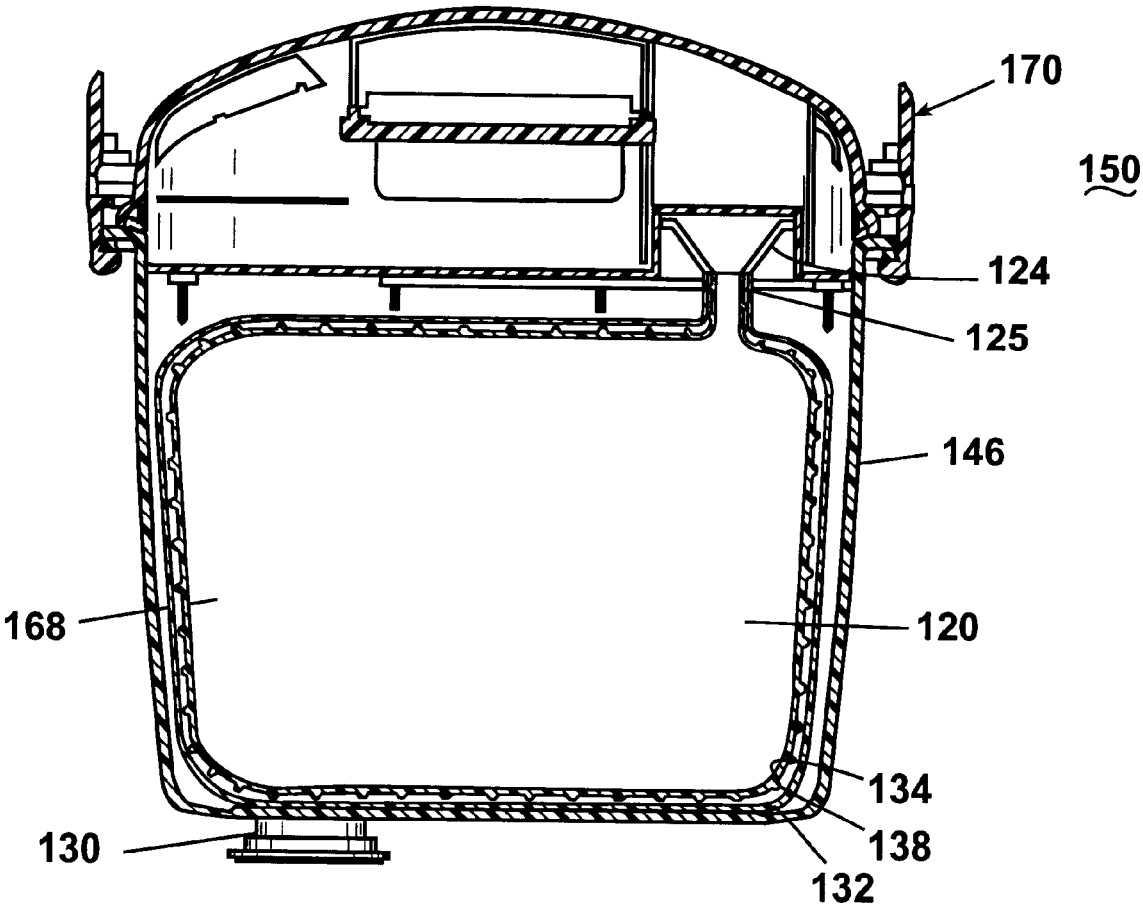
FIG. 4 is a cross-sectional view of a further embodiment of the solution/recovery tank assembly of the upright extractor shown in FIGS. 1–2.

Referring to FIG. 4, the further embodiment of a thermally insulated solution tank 120 is disclosed. The solution tank 120 includes an outer wall 132 and an inner wall 134. The inner wall 134 further comprises a plurality of integrally formed ribs 138. The ribs 138 are sufficiently stiff to maintain an air gap between the outer wall 132 and the inner wall 134, but must be sufficiently flexible for solution tank 120 to collapse as cleaning solution is dispensed and recovered fluid is deposited in recovery tank 146. This air gap serves to thermally isolate the interior of the solution tank 120 from the atmosphere or any fluid contained in the rigid recovery tank 146 outside of the solution tank 120.

Figure 5:
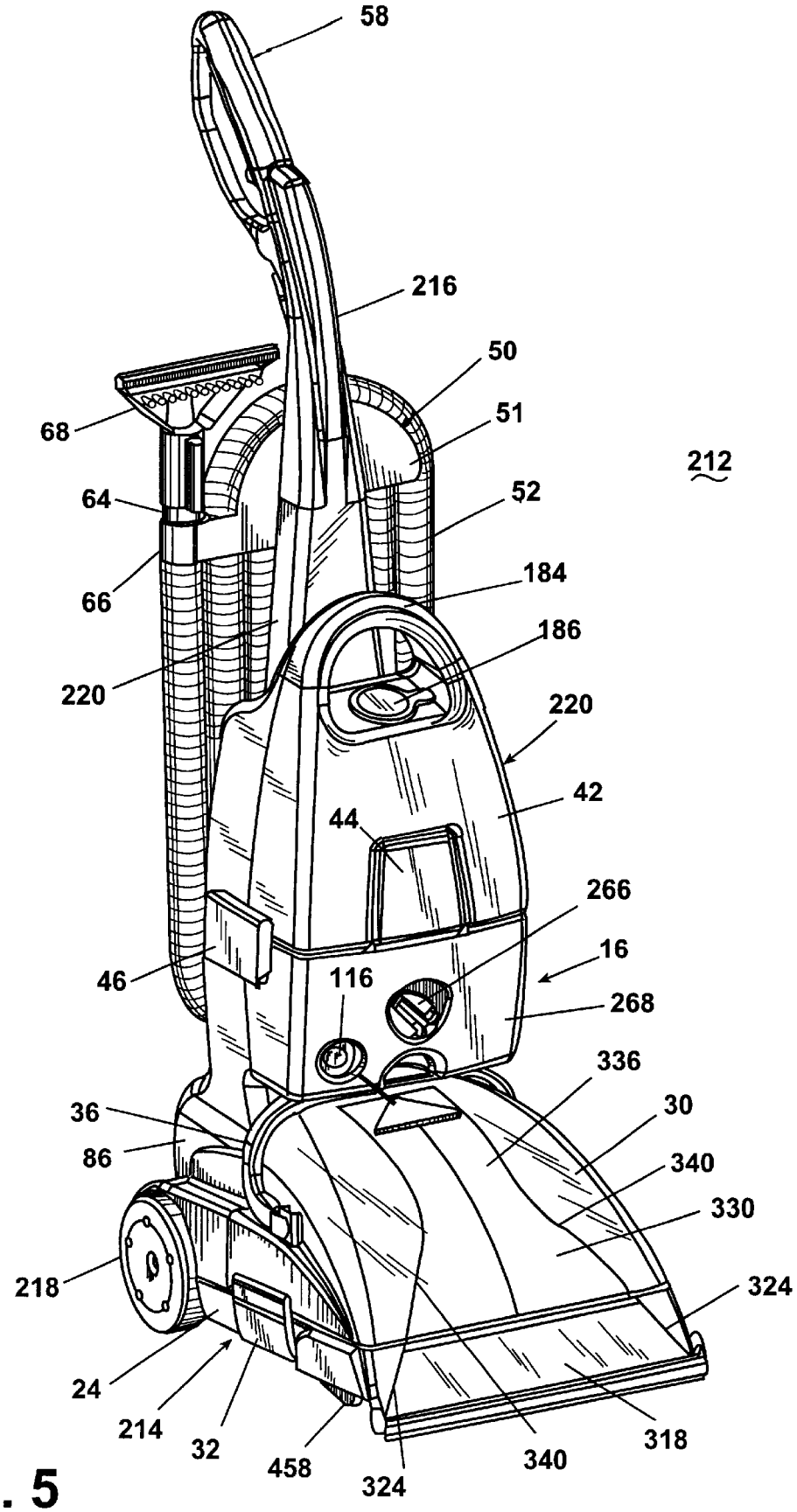
FIG. 5 is a perspective view of an upright extractor according to a further embodiment of the invention.
Figure 6:
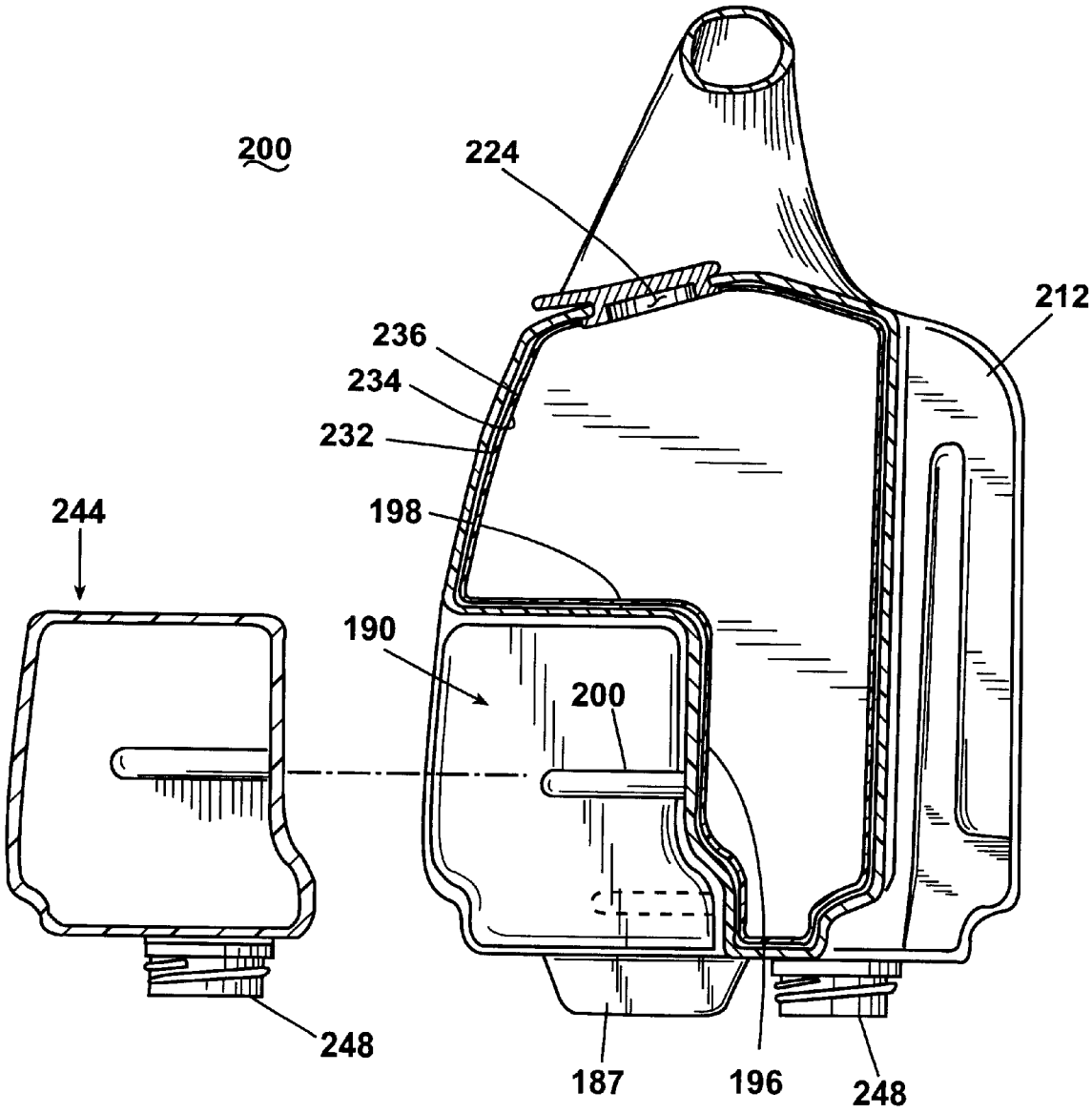
FIG. 6 is a cross-sectional view of a solution tank assembly of the upright extractor shown in FIG. 5.

Referring to FIGS. 5–6, a further embodiment of an upright extraction cleaning machine 212 comprises a base module 214, an upright handle 216 pivotally mounted to the base module 214 and a pair of wheels 218 supporting in part the base module 214. A cleaning solution tank 220 is removably mounted to the upright handle 216 for fluidly connecting to a solution dispensing system for applying a cleaning solution to a surface being cleaned. The upright extraction cleaning machine 212 of FIGS. 5–6 is further described in commonly owned U.S. Pat. No. 5,896,617, which is incorporated herein by reference in its entirety.

Referring to FIG. 6, the cleaning solution tank 220 comprises a double wall construction having an outer wall 232 and an inner wall 234. The inner wall 234 forms a chamber for retaining a cleaning solution.

The outer wall 232 and the inner wall 234 are separated by an air gap 236 for thermally isolating the cleaning solution from the atmosphere to reduce heat loss. The inner wall 234 is separated from the outer wall 232 except at a filler opening 224 for filling the solution tank 220 with a cleaning solution and at a threaded neck 248 positioned in a bottom portion of the solution tank 220 for receiving a valve assembly for fluidly connecting with the solution dispensing system.

In a preferred embodiment, the outer wall 232 is blow-molded. A secondary blow-molding process forms the inner wall 234 within the cavity of the outer wall 232. In a further embodiment, the inner wall 234 is formed by a blow-molding process. The outer wall 232 is then formed such as by a two-piece injection-molding process. The two-piece outer wall 232 is then assembled around the blow-molded inner wall 234 to form the thermally insulated solution tank 220.

The solution tank 220 is molded with a cavity 190 for receiving a detergent tank 244. The solution tank 220 and detergent tank 244 are removably mounted as a unit to the upright handle 216 of the upright extraction cleaning machine 212 for fluidly connecting to the solution dispensing system.

Figure 7:
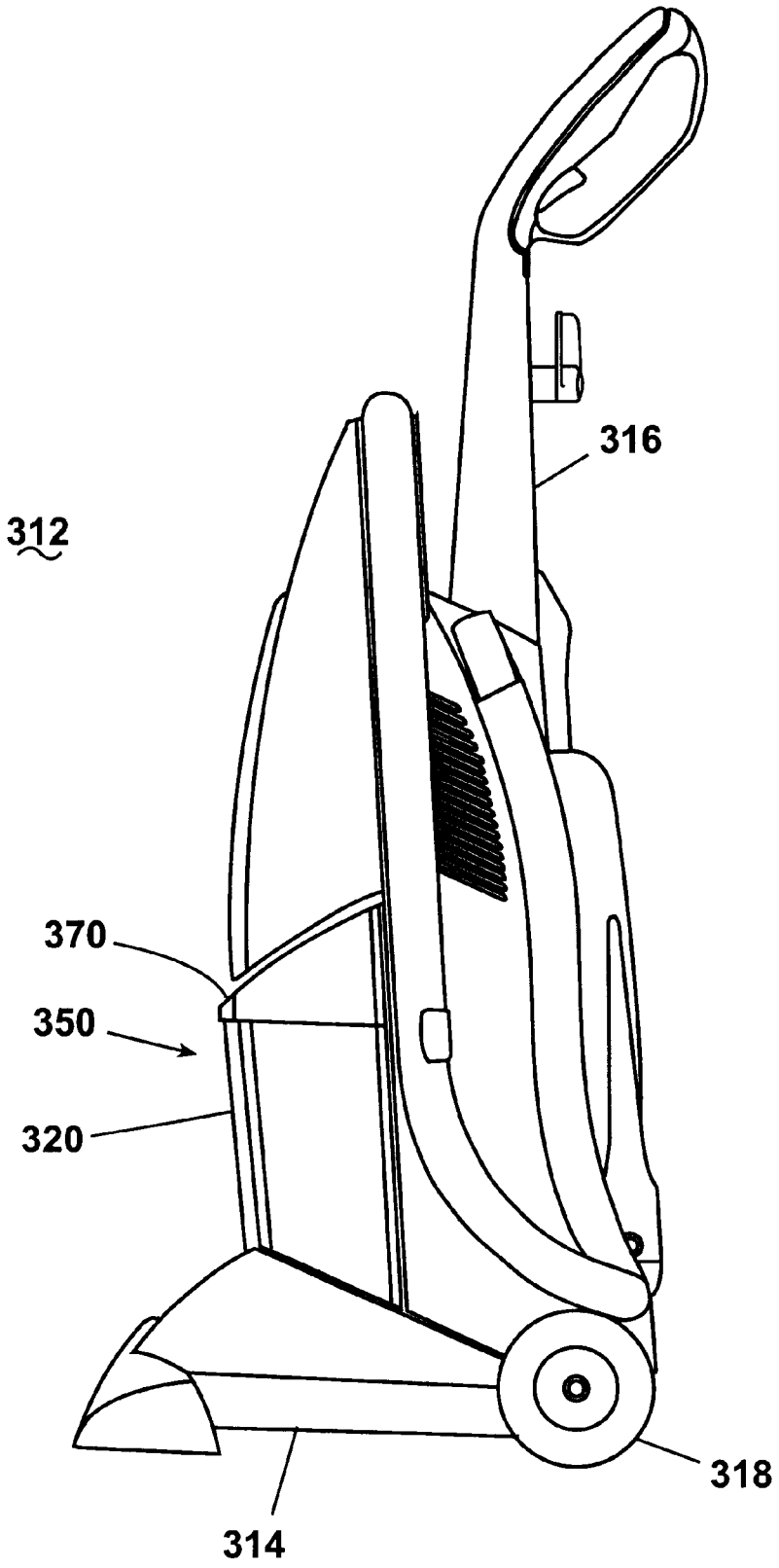
FIG. 7 is a side view of an upright extractor according to a further embodiment of the invention.
Figure 8:
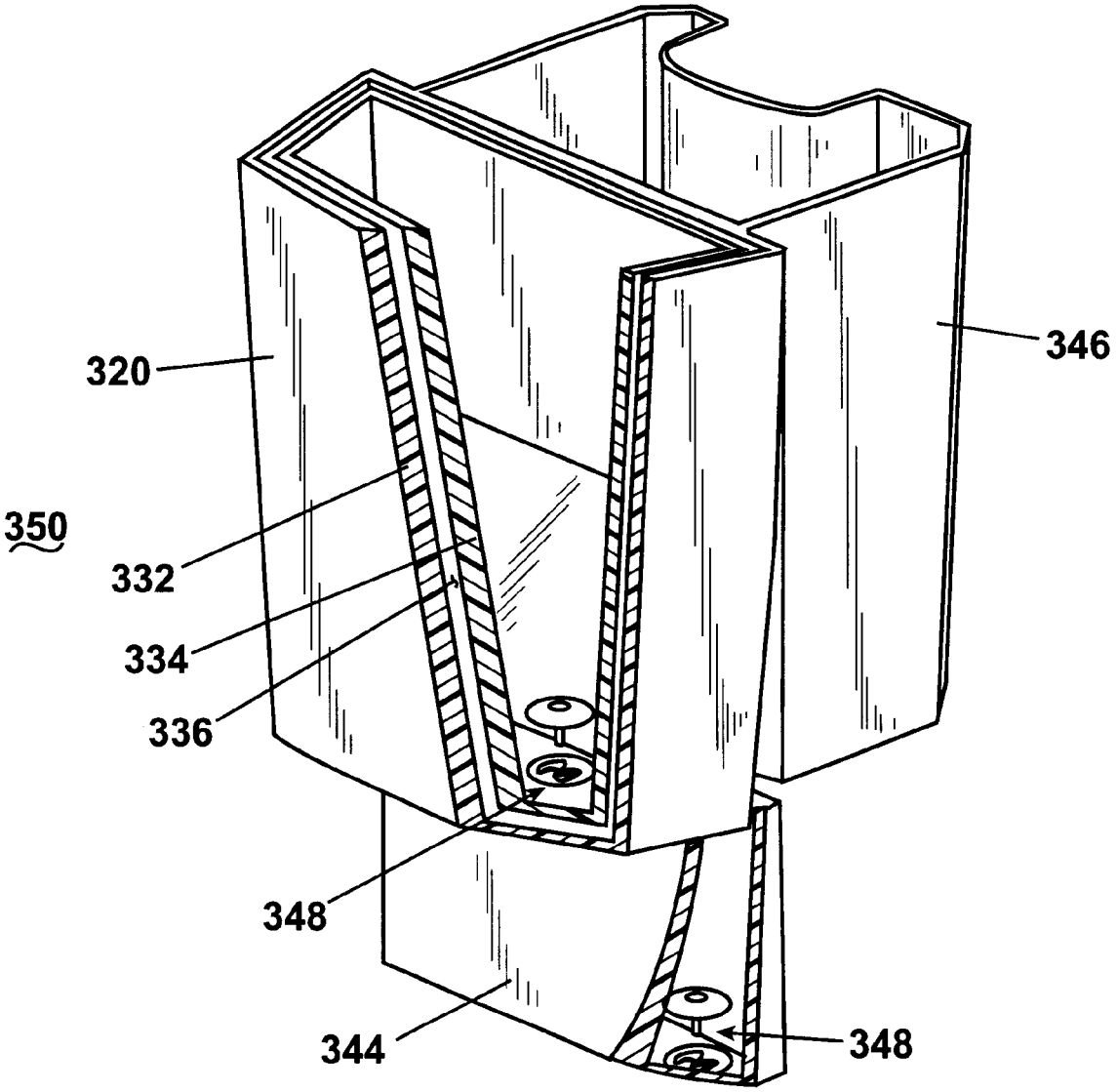
FIG. 8 is a perspective view in section of a solution/recovery tank assembly of the upright extractor shown in FIG. 7.
Figure 9:
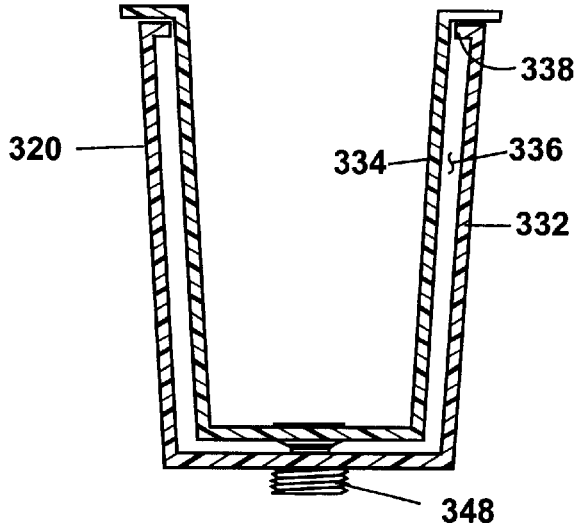
FIG. 9 is a partial cross-sectional view of a further embodiment of a solution tank of an upright extractor according to the invention.

A further embodiment of an upright extraction cleaning machine 312 is shown in FIGS. 7–9. The upright extraction cleaning machine 312 comprises a base module 314, an upright handle 316 pivotally mounted to the base module 314 and wheels 318 for supporting the upright extraction cleaning machine 312. A solution/recovery tank assembly 350 having a cover 370 is removably mounted on the base module 314. The upright extraction cleaning machine 212 of FIGS. 7–8 is further described in commonly owned U.S. Pat. No. 5,896,617, which is incorporated herein by reference in its entirety.

Referring to FIG. 8, the solution/recovery tank assembly 350 includes a solution tank 320, a recovery tank 346 and a detergent tank 344. When mounted on the base module 314, the solution tank 320 and detergent tank 344 are fluidly connected to a solution dispensing system of the upright extraction cleaning machine 312 through a self-sealing valve assembly 348. The recovery tank 346 is fluidly connected to the fluid recovery system of the upright extraction cleaning machine 312.

The solution tank 320 is formed with an outer wall 332 and an inner wall 334 separated by an air space 336 for thermally isolating the interior of the solution tank 320 from the atmosphere and from the recovery tank 346. In the preferred embodiment, the solution/recovery tank assembly 350 is integrally molded so that the recovery tank 346 and the outer wall 332 of the solution tank 320 are formed in a single piece. The inner wall 334 is separately formed and joined with the outer wall 332 of the solution tank 320 to thermally insulate the interior of solution tank 320.

Figure 10:
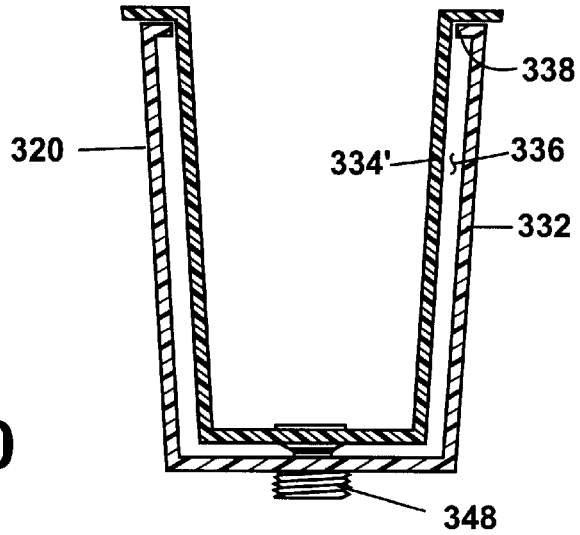
FIG. 10 is a partial cross-sectional view of a further embodiment of a solution tank of the upright extractor shown in FIGS. 5–8.
Figure 11:
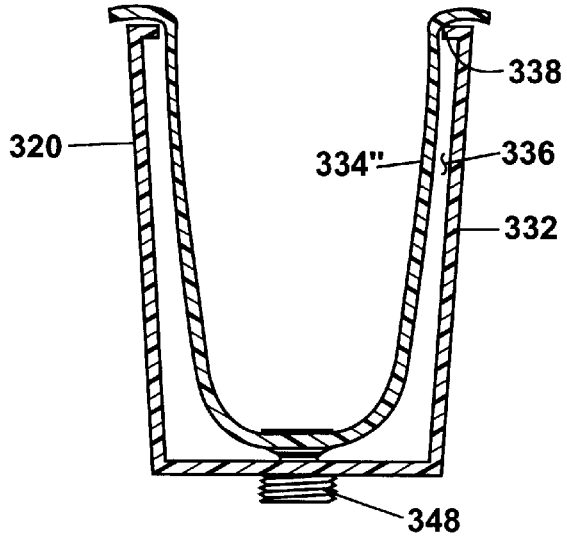
FIG. 11 is a partial cross-sectional view of a further embodiment of a solution tank of the upright extractor shown in FIGS. 5–8.

Referring to FIGS. 9–11, three proposed methods of forming inner wall 334 are disclosed. In FIG. 9, inner wall 334 comprises an injection-molded liner connected to outer wall 332 at an upper lip 338 and a valve assembly 348 for fluidly connecting to a solution dispensing system. Inner wall 334 is generally configured to parallel outer wall 332 while leaving an air space 336 therebetween. The air space 336 thermally isolates the interior of solution tank 320 from the atmosphere. In FIG. 10, inner wall 334' is a blow-molded configuration likewise connected to outer wall 332 at upper lip 338 and valve assembly 348. In FIG. 11, inner wall 334" is a flexible bladder wholly contained within the outer wall 332 and connected only at the upper rim of inner wall 334" and at valve assembly 348. Inner wall 334" is configured to remain isolated from an outer wall 332 to create air space 336 for thermally isolating the interior of solution tank 320 from the atmosphere.

It is anticipated that the inner and outer wall configurations of FIGS. 9–11 can further be applied to the embodiment of FIGS. 5–6. For instance, solution tank 220 can be fitted with a flexible bladder to form inner wall 234, the flexible bladder being configured to maintain an air space 236 between inner wall 234 and outer wall 232, the flexible bladder being secured to the outer wall 232 only at the filler opening 224 and the threaded neck 248.

Figure 12:
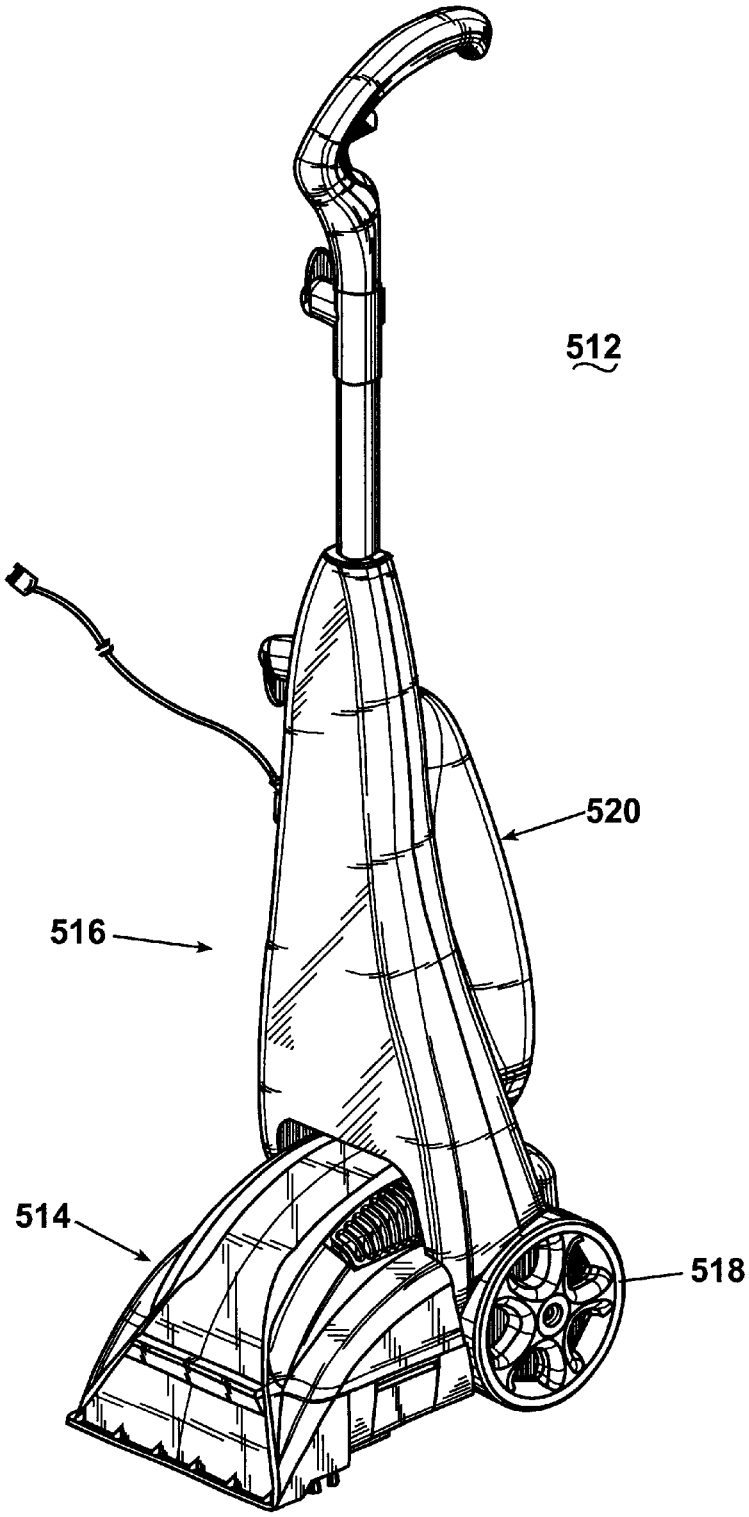
FIG. 12 is a perspective view of an upright extractor according to a further embodiment of the invention.
Figure 13:
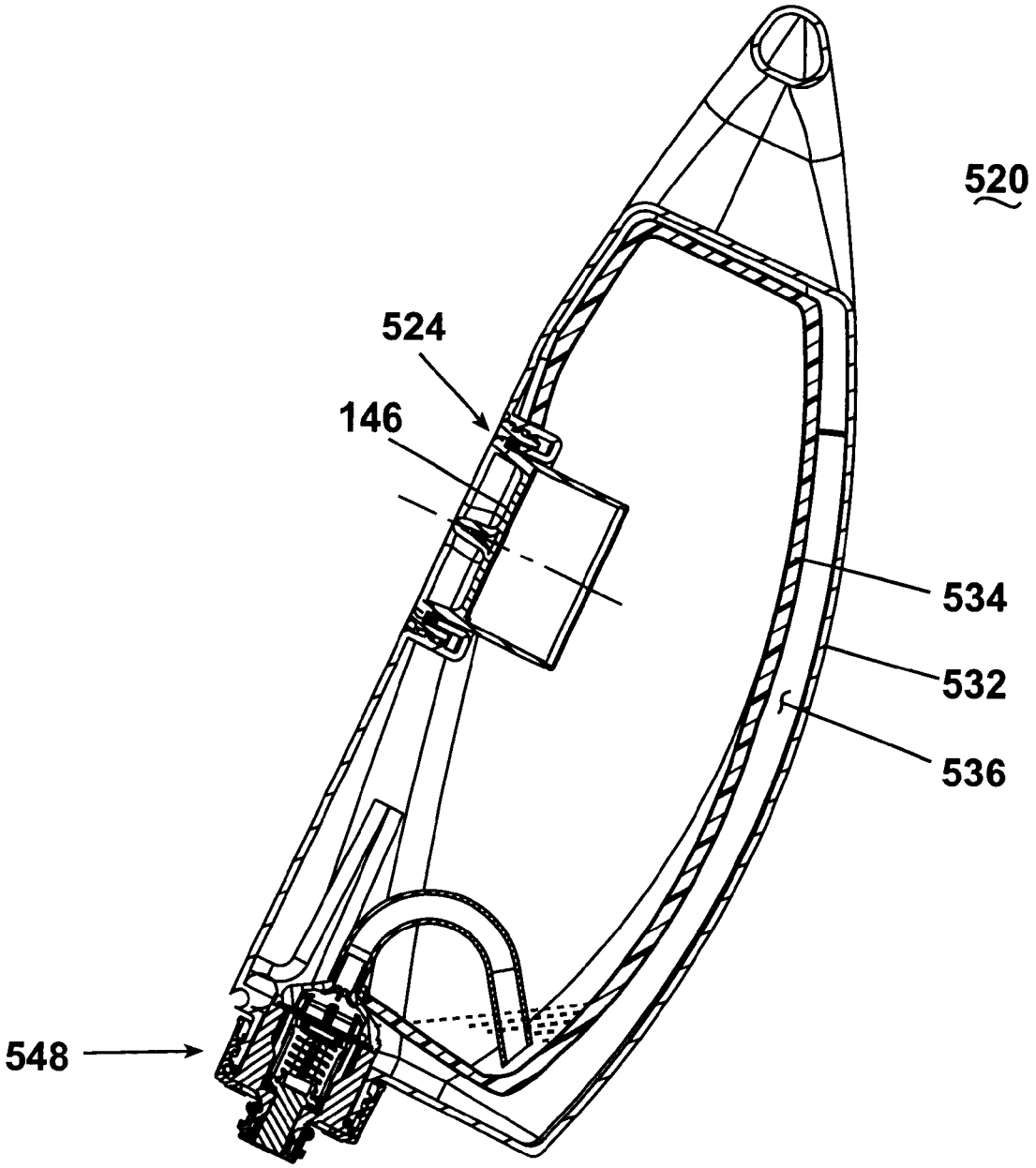
FIG. 13 is a cross-sectional view of a solution tank of the upright extractor shown in FIG. 12.

A further embodiment of an upright extraction cleaning machine 512 is disclosed in FIGS. 12–13. The upright extraction cleaning machine comprises a base module 514, an upright handle 516 pivotally mounted to the base module 514 and a pair of wheels 518 supporting in part upright extraction cleaning machine 512. A solution tank 520 is removably mounted on the upright handle 516 for fluidly connecting to a solution dispensing system of the upright extraction cleaner. The upright extraction cleaning machine 512 is further described in commonly owned pending U.S. patent application Ser. No. 09/755,724 filed Jan. 5, 2001, now U.S. Pat. No. 6,467,122 which is incorporated herein by reference in its entirety.

Referring to FIG. 13, the solution tank 520 is formed with an outer wall 532 and an inner wall 534 separated by an air space 536 for thermally isolating the interior of the solution tank 520 from the atmosphere. The outer wall 534 and inner wall 532 are connected at a fill opening 524 and a self sealing valve assembly 548 for holding the outer wall 532 and inner wall 534 in a position to maintain air space 536 therebetween.

Figure 14:
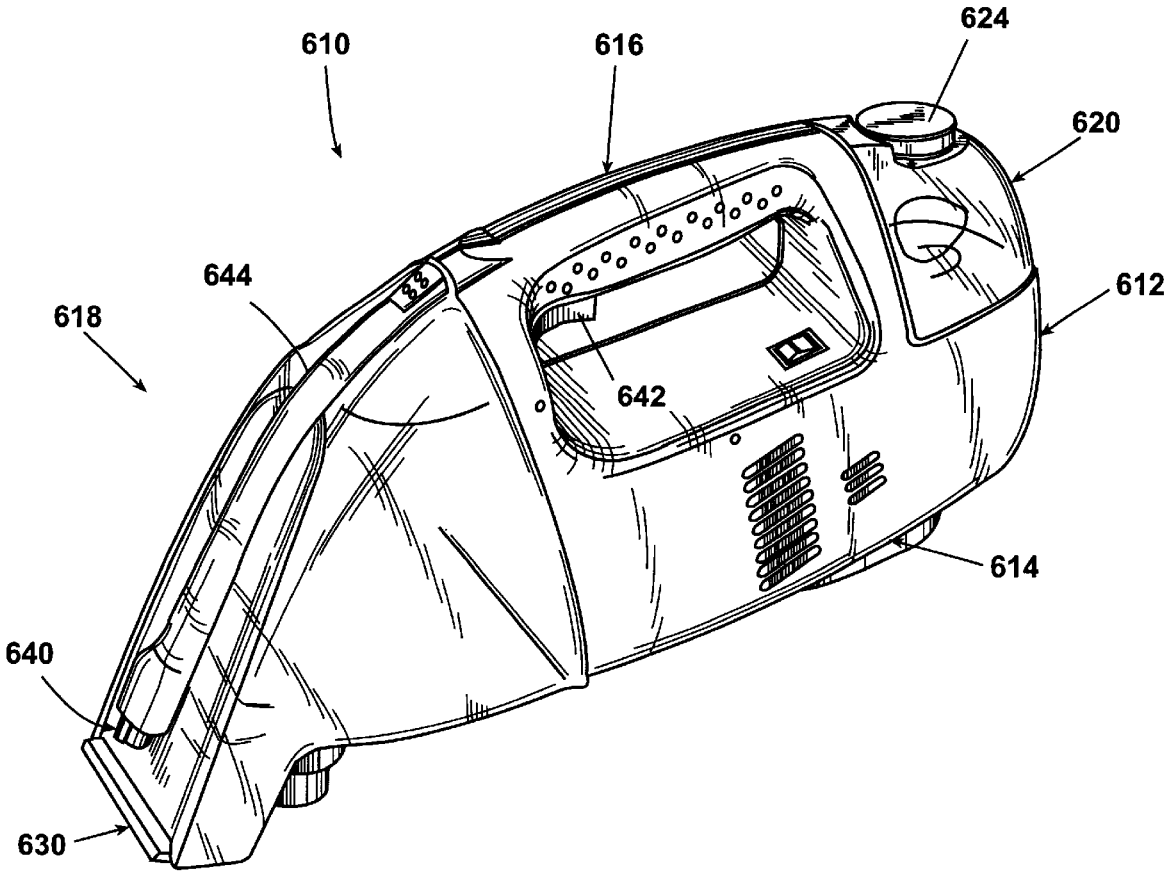
FIG. 14 is a perspective view of a hand-held extractor according to the invention.
Figure 15:
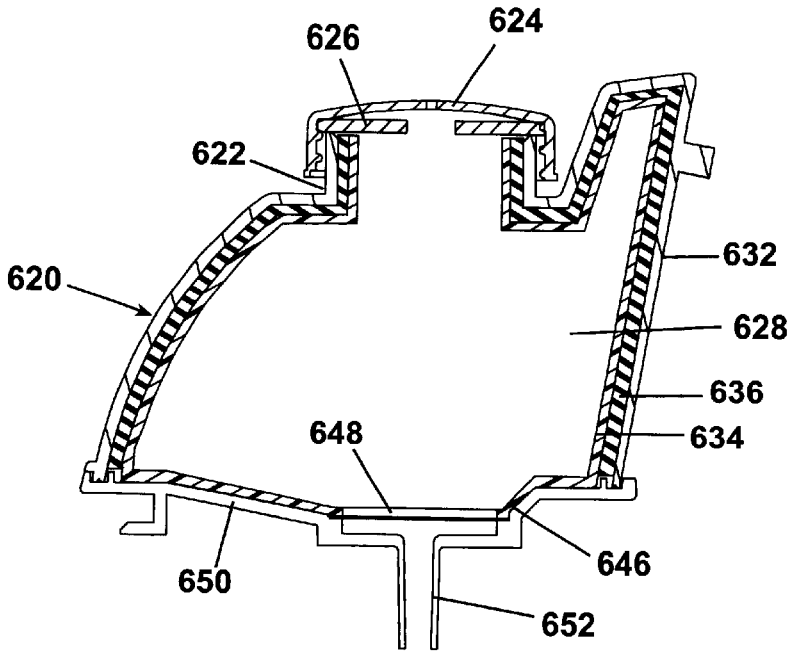
FIG. 15 is a cross-sectional view of a solution tank of the hand-held extractor shown in FIG. 14.
Figure 16:
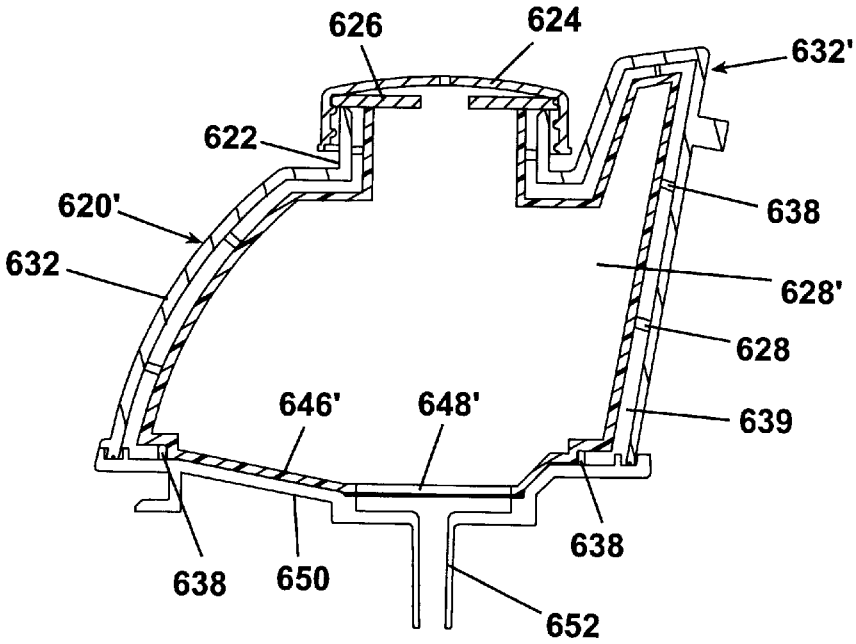
FIG. 16 is a cross-sectional view of a further embodiment of a solution tank of the hand-held extractor shown in FIG. 14.

Referring to FIGS. 14–16, a further embodiment of an insulated solution tank 620 is disclosed for a hand-held extraction cleaning machine 612. The hand-held extraction cleaning machine 612 is further described in detail in commonly owned U.S. Pat. No. 6,125,498, which is incorporated herein by reference in its entirety.

Referring to FIGS. 14–16, a hand-held extraction cleaning machine 610 has a rear portion 612, a bottom portion 614, a handle portion 616 and a removable recovery tank 618. An insulated solution tank 620 has a threaded neck 622 on which is a mounted a threaded, vented cap 624. An annular seal 626 is provided between the threaded neck 622 and the vented cap 624. The removable recovery tank 618 has a suction nozzle 630 mounted to a front portion thereof. A spray dispenser 640 is mounted on a front face of the recovery tank 618 and is connected through a conduit 644 to a pump operated by a trigger 642. The pump in turn is connected to the insulated solution tank 620. Further details of the hand-held extraction cleaning machine, with the exception of the insulated solution tank 620, are disclosed in U.S. Pat. No. 6,125,498 which is incorporated herein by reference in its entirety.

In FIG. 15, a first embodiment of the insulated solution tank 620 is formed with an exterior wall 632 and an interior wall 634 forming a double wall construction. A bottom wall 650 has an outlet conduit opening 648 for dispensing cleaning fluid to a pump or other type of dispenser. The interior wall 634 includes a bottom wall 646 having an outlet opening 648. The solution tank further comprises an insulator 636 between the interior wall 634 and the exterior wall 632. Interior wall 634 defines an interior chamber 628 of the solution tank. In one embodiment, the solution tank can be formed by blow-molding. The insulator 636 can be air or a solid insulating material, such rigid foam. In this event, the solid insulating material can form one or both of the inner surface and outer surface of the solution tank. In addition, the insulating material can be a flexible foam, either closed cell or open cell, or can be a fibrous batting, such as fiberglass. In another embodiment, the insulated solution tank can be formed of a shell on which an insulated coating is formed.

Referring now to FIG. 16, a further embodiment of the invention illustrated in FIGS. 14 and 15 is shown wherein like numerals are used to designate similar parts with a prime (') mark. An insulated solution tank 620' for a hand-held extractor has an interior chamber 628' formed by a single injection-molded interior wall 634'. The interior wall 634' is spaced from the solution tank exterior wall 632' by a plurality of ribs 638 extending in a perpendicular fashion from the exterior surface of the interior chamber to form am air space 639 between the interior chamber 628' and the exterior wall 632'. The resulting air space 639 insulates the warm solution contained in the solution tank and impedes heat transfer from the inner chamber 628' to the exterior wall 632'.

The invention is effective to maintain the temperature of a cleaning solution at an elevated temperature for an extended period of time to enhance the cleanability of the extraction machine. Further, the insulation protects a user from the heat of very hot cleaning solution in the tank and thus enhances the temperature that can be safely placed in the tank. Thus, not only can the insulated tank maintain the temperature of the cleaning solution at an elevated temperature, but can safely hold cleaning solution with higher initial temperatures without burning the person who must place the solution tank on the extractor housing or body. Thus, the cleanability of the extractor is further extended.

While the invention has been specifically described in connection with certain specific embodiments thereof, it is to be understood that this is by way of illustration and not of limitation. Reasonable variation and modification are possible within the scope of the forgoing description and drawings without departing from the scope of the invention which is described in the appended claims.

What is claimed is:

1. A portable surface cleaning apparatus, comprising:

a base module for movement along a surface and comprising a base housing;

an upright handle pivotally mounted to the base module;

a fluid recovery system comprising:

a tank having a fluid recovery chamber for holding recovered fluid;

a suction nozzle associated with the base module;

a working air conduit extending between the recovery chamber and the suction nozzle; and a vacuum source in fluid communication with the recovery chamber for generating a flow of working air from the nozzle through the working air conduit and through the recovery chamber to thereby draw dirty liquid from the surface to be cleaned through the nozzle and working air conduit, and into the recovery chamber; and a liquid dispensing system comprising:

a liquid dispensing nozzle associated with the base module for applying liquid to a surface to be cleaned;

a fluid supply tank for holding a predetermined amount of supply fluid; and a fluid supply conduit fluidly connected to the fluid supply tank and to the dispensing nozzle for supplying liquid to the dispensing nozzle;

the improvement comprising:

the fluid supply tank comprising a thermally insulated tank wall.

2. The portable surface cleaning apparatus of claim 1, wherein the tank wall comprises an inner wall and an outer wall.

3. The portable surface cleaning apparatus of claim 2, wherein the inner wall and the outer wall are separated by an air space therebetween.

4. The portable surface cleaning apparatus of claim 2, wherein the inner wall and the outer wall are separated by an insulating material.

5. The portable surface cleaning apparatus of claim 4, wherein the insulating material is foam or a fibrous batting.

6. The portable surface cleaning apparatus of claim 2, wherein the inner wall is a flexible bladder.

7. The portable surface cleaning apparatus of claim 6, wherein the outer wall is a flexible bladder.

8. The portable surface cleaning apparatus of claim 2 wherein one of the inner wall and the outer wall includes integrally molded ribs for maintaining a separation distance between the inner wall and the outer wall.

9. The portable surface cleaning apparatus of claim 1 wherein the tank wall comprises a foam material.

10. The portable surface cleaning apparatus of claim 1 wherein the thermally insulated tank wall includes an insulation coating.

11. The portable surface cleaning apparatus of claim 1 wherein the tank wall includes a flexible bladder.

12. A hand-held surface cleaning apparatus, comprising:

a housing including a handle for carrying the cleaning apparatus;

a fluid recovery system comprising:

a tank having a fluid recovery chamber for holding recovered fluid;

a suction nozzle associated with the housing;

a working air conduit extending between the recovery chamber and the suction nozzle; and a vacuum source in fluid communication with the recovery chamber for generating a flow of working air from the nozzle through the working air conduit and through the recovery chamber to thereby draw dirty liquid from the surface to be cleaned through the nozzle and working air conduit, and into the recovery chamber; and a liquid dispensing system comprising:

a liquid dispensing nozzle associated with the housing for applying liquid to a surface to be cleaned;

a fluid supply tank for holding a predetermined amount of supply fluid; and a fluid supply conduit fluidly connected to the fluid supply tank and to the dispensing nozzle for supplying liquid to the dispensing nozzle; the improvement comprising:

the fluid supply tank comprising a thermally insulated tank wall.

13. The hand-held surface cleaning apparatus of claim 12, wherein the tank wall comprises an inner wall and an outer wall.

14. The hand-held surface cleaning apparatus of claim 13, wherein the inner wall and the outer wall are separated by an air space therebetween.

15. The hand-held surface cleaning apparatus of claim 13, wherein the inner wall and the outer wall are separated by an insulating material.

16. The hand-held surface cleaning apparatus of claim 15, wherein the insulating material is foam or a fibrous batting.

17. The hand-held surface cleaning apparatus of claim 13, wherein one of the inner wall and the outer wall comprises integrally molded ribs for maintaining a separation distance between the inner wall and the outer wall.

18. The hand-held surface cleaning apparatus of claim 12, wherein the tank wall is formed of a closed-cell foam.

* * * * *